United States Patent [19]

Castonguay

[11] 4,004,564

[45] Jan. 25, 1977

[54] BOW STRING RELEASE

[75] Inventor: Leon H. Castonguay, Wheelright, Mass.

[73] Assignee: Astratronics, Inc., Wheelwright, Mass.

[22] Filed: June 26, 1975

[21] Appl. No.: 590,637

[52] U.S. Cl. ..... 124/35 A
[51] Int. Cl.[2] ..... F41C 19/00
[58] Field of Search ..... 124/35 A, 24 R, 23 R

[56] References Cited

UNITED STATES PATENTS

| | | | |
|---|---|---|---|
| 3,375,815 | 4/1968 | Novak | 124/30 A X |
| 3,845,752 | 11/1974 | Barner | 124/35 A |
| 3,929,120 | 12/1975 | Barner | 124/35 A |
| 3,937,206 | 2/1976 | Wilson | 124/35 A |

*Primary Examiner*—Richard C. Pinkham
*Assistant Examiner*—William R. Browne
*Attorney, Agent, or Firm*—Norman S. Blodgett; Gerry A. Blodgett

[57] ABSTRACT

A mechanical device for releasing a bow string in archery, involving a housing, a nib mounted in the housing, a holding cord wrapped around the bow string and held by the nib, and a trigger actuated sear mechanism controlling release of the nib. The nib is on a nib bar which is pivoted at an intermediate portion. A sear bar is pivotally mounted in the housing for movement away from the nib bar. Said sear bar engages the edge of the nib bar to prevent same from pivoting. A trigger is pivotally mounted in the housing intermediate its ends. The trigger has one end which engages the sear and is removed from the sear by manual actuation of the trigger. The movement of the sear by the trigger causes the sear to release the nib, the latter then rotating about its axis to release a bow string which is being held by a looped cord attached to the housing.

6 Claims, 4 Drawing Figures

BOW STRING RELEASE

BACKGROUND OF THE INVENTION

Archery, both as a hunting technique and as a formal competitive sport, is an activity which has maintained a wide spread popularity almost from the beginning of recorded history. The intense modern popularity of archery would seem surprising in view of the technical innovations in firearms which have rendered archery somewhat obsolete. Several factors cause large numbers of hunters and competitors to prefer a bow and arrow to a firearm. Many sportsmen feel that the silence and high degree of human involvement found in archery make it a more "sporting" technique. Archery is also considered safer both for the bowman and for others in the area. Perhaps more important, however, is the introduction of modern materials and techniques to the manufacture of both bows and arrows. This factor both reduces the cost of the equipment and the effort necessary to maintain it. The quality of modern equipment has also vastly increased the accuracy which an archer can achieve. The elimination of many of the equipment shortcomings (which were the major factor in limiting the accuracy of an archer) has resulted in a truly remarkable increase in the accuracy that a normal archer can expect. This elimination has also, however, increased the importance of other factors which effect accuracy. One of the most important of these other factors is the smoothness and consistency by which the archer releases the drawn bow string. The quality of this bow string release technique is critical, because any extraneous vibrations or torque applied to the arrow precisely at the location and moment that the force of the string is applied to the arrow, is amplified and becomes a substantial source of inaccuracy. This peculiarity is demonstrated geographically by the substantial increase in accuracy resulting from a change in fingering from the so-called "Hunter" grip in which the forefinger grips the string above and the middle and third fingers grip the string below the arrow, to the "String Walker" grip in which the forefinger is moved below the arrow. Similar substantial increases in average accuracy have been achieved by means of mechanical bow string releases. These mechanical releases originally involved a handle with a rigid hook which engaged the bow string. By twisting the handle, the hook would release the string without the substantial frictional effects which normally occur between the archer's finger and the string and arrow and which contributed, not only considerable extraneous vibration to the arrow, but also considerable abrasion to the archer's fingers. The drawback of this sort of mechanical release was not only that the passage of the string over the point of the hook still introduced extraneous vibrations that the finger grip introduced, but the substantial movement of the handle required to effect the release also interfered with the aiming of the arrow and with maintaining the bow and release steady while shooting. Various devices aimed at overcoming these problems have involved cumbersome and complicated mechanical structures which were expensive and were generally not effective. These and other difficulties experienced with the prior art devices have been obviated in a novel manner by the present invention.

It is, therefore, an outstanding object of the present invention to provide a bow string release which allows smooth and reproducible release of a bow string to shoot an arrow.

Another object of this invention is the provision of a bow string release which minimizes the introduction of extraneous vibrations into the release of an arrow.

A further object of the present invention is the provision of a bow string release which is simple to operate.

It is another object of the instant invention to provide a bow string release which can be inexpensively manufactured in a durable and attractive form.

A still further object of the invention of a bow string release which minimizes destructive abrasion of the bow string.

It is a further object of the present invention to provide a bow string release in which the movement required by the operator to effect the release is an absolute minimum.

With these and other objects in view, as will be apparent to those skilled in the art, the invention resides in the combination of parts set forth in the specification and covered by the claims appended hereto.

SUMMARY OF THE INVENTION

This invention involves a bow string release comprised of a holding cord, one end of which is attached to the housing and which passes around the bow string, a nib which grasps the other end of the holding cord, and a lock mechanism which causes the nib to release the said other end of the holding cord. The locking mechanism involves a sear, which allows the nib to release the holding cord in response to a slight movement of a trigger by the archer.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
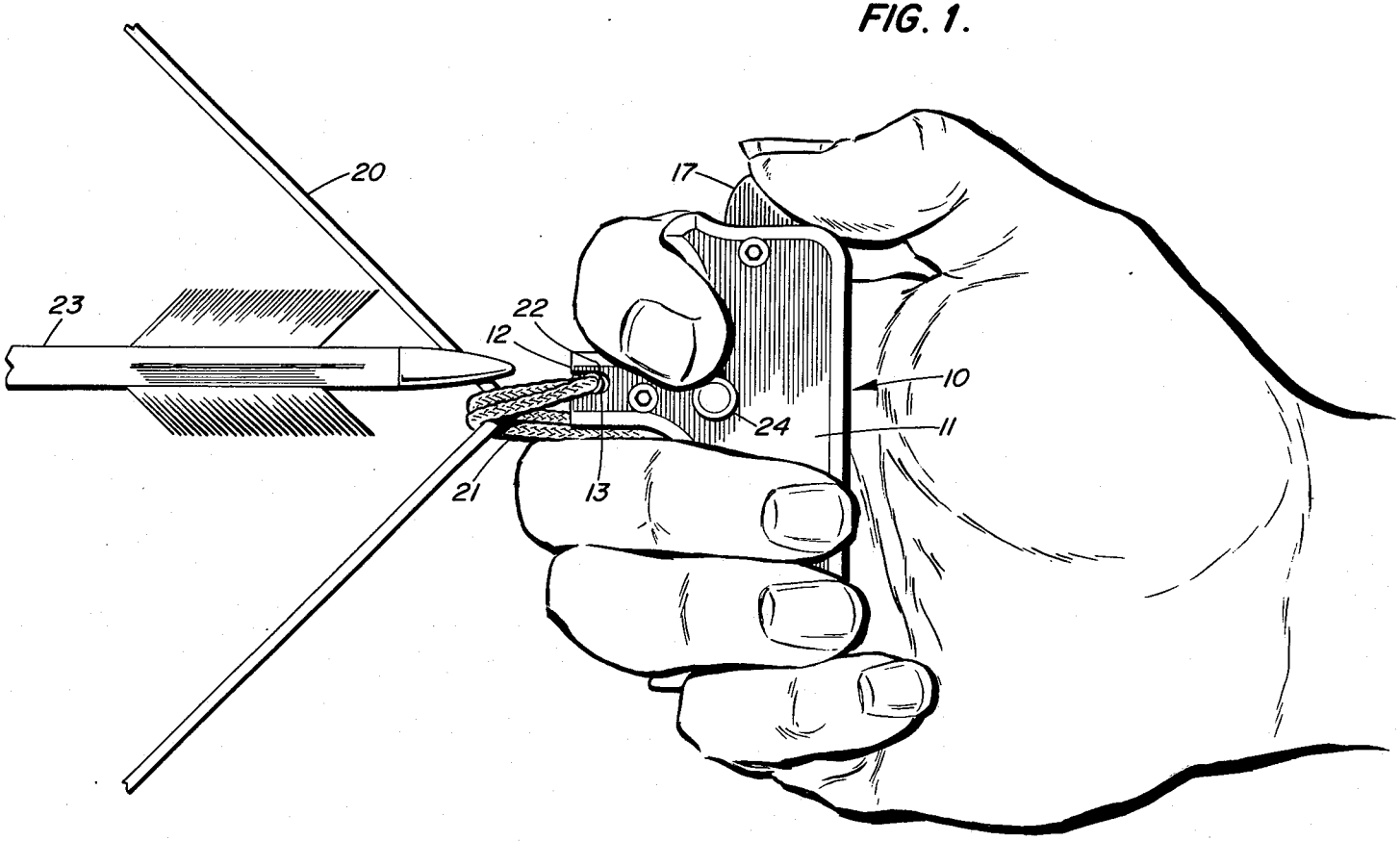
FIG. 1 is a perspective view showing a bow release embodying the principles of the present invention as it would be used to draw a bow string.

Referring first to FIG. 1, in which the general features of the present invention are best shown, the bow string release, designated generally by the numeral 10, is shown to include a housing 11 and a holding cord or loop 21. The housing 11 is shaped to be held in the hand of the operator (as shown), and includes a forwardly directed nose 12, a slot 13 in the nose, and an actuator 17 which can be engaged by the thumb of the operator. Also, shown on the housing is locking button 24.

The holding cord 21 has one end which is connected to the housing 11 and another end which is held in the slot 13. The end which is held in the slot 13 has a bushing 22. The central portion of the holding cord passes around the bow string 20 which is notched to arrow 23.

Figure 2:
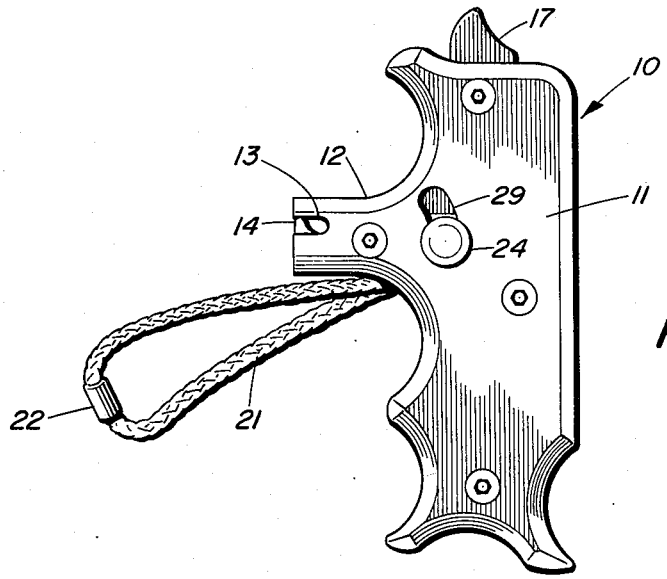
FIG. 2 is a plan view of a bow release embodying the principles of the present invention.

Referring to FIG. 2, it can be seen that the holding cord 21 is actually a loop, the ends of which are connected to the housing and the bight of which carries the annular bushing 22. Also shown is the nib 14 which passes from the housing into the slot to engage the bushing and hold retain the holding cord 21.

Figure 3:
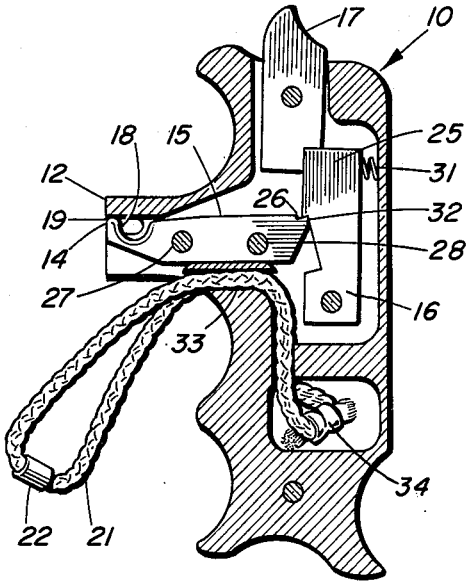
FIG. 3 is a sectional view of the bow release shown in FIG. 2.
Figure 4:
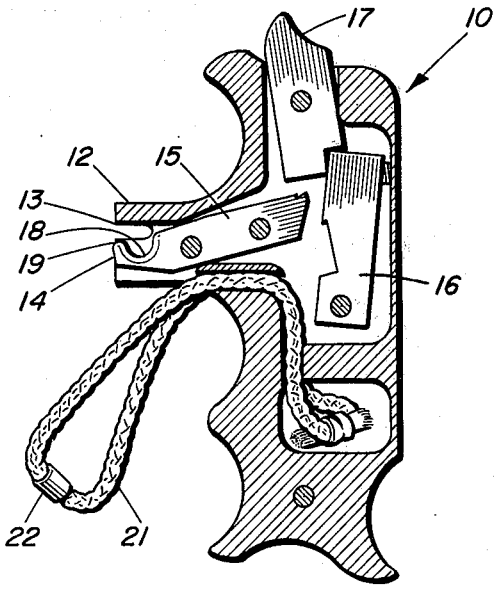
FIG. 4 is a sectional view of the bow release shown in FIG. 2.

Referring to FIG. 3, which is a sectional view of the release shown in FIG. 2, the locking mechanism 25 is shown to include a nib bar 15, a sear bar 16, and an actuator 17. The nib bar 15 carries the nib 14 at one end, an edge 26 at the other end, and is pivotally mounted in the housing at its central portion on axis 27. If a vertical center horizontal line were drawn in the plane of the figure through the slot 13, the axis 27 of the nib bar 15 would be below that center line. In this way pressure on the nib directed toward the left in the drawing would cause the nib to move out of the slot 13. The locking button 24 which is shown in FIG. 2, is connected through the housing to the nib bar 15 at aperture bore 28. The locking button 24 is allowed to ride with the pivoting action of the nib bar 15 because it passes through the housing in a locking button slot 29, shown in FIG. 2.

Sear bar 16 is pivotally mounted on one of its ends to the housing and biased by a spring 31 toward the nib bar 15. The sear bar 16 is arranged generally perpendicular to the nib bar 15 and engages the edge 26 of the nib bar 15 by sear 32. There is an extremely short engagement between the sear and the edge, i.e., the depth of contact between the parallel surfaces of the sear and the edge is short, so that a very small movement of the sear away from the edge changes the positive parallel surface contact to disengagement.

Also pivotally mounted at its central portion is actuator 17. One end of actuator 17 extends outwardly of the housing for engagement by the thumb of the operator. The other end of the actuator 17 engages the free end of the sear bar 16 to transmit movement of the operator's thumb to the sear bar.

The housing itself is formed of two mirror-image halves, whose facing surfaces have been milled out to provide recesses in which the operating elements of the device are held. The holding cord 21 passes through grooves 33 in the surfaces of the housing. On the inside end of the holding cord 21 is pressed a block 34 which holds the ends of the holding cord 21 in the housing when the halves are assembled, thereby locking the end of the cord in the housing when the halves are assembled.

The use and operation of the invention will now be readily understood in view of the above description. The operator grasps the housing 11 in his hand with the thumb adjacent the actuator 17. Initially, the nib 14 is withdrawn from the slot 13. The holding cord 21 is wrapped once around the bow string 20 and the bushing 22 is placed in the slot 13. The operator's thumb presses the locking button 24 downwardly toward his little finger, thereby causing the nib 14 to enter the slot and hold the bushing 22 in place. This action has also caused the edge 26 to engage the sear 32 which holds the nib in place. The operator then notches the arrow 23 and draws back the bow string release and thereby the bow string and arrow. When the arrow has been properly aimed the operator presses forwardly on the actuator 17 and slight movement of the actuator causes movement of the sear bar which, in turn, releases the edge 26 from the sear 32. This, in turn, allows the pressure of the bushing 22 to cause the nib 14 to move out of the slot. The holding cord 21 releases the bow string 20 and the arrow is let fly.

It is important to recognize that the sear action of the locking mechanism allows an extremely small motion of the operator's thumb on the actuator 17 to move the device from a position in which the bow string is positively held to a position in which it is completely released, without going through a spectrum of unstable intermediate states which result in unwanted torque being imparted to the string and arrow. In addition, the bow string itself is not exposed to the damaging effect that hard metal nibs or hooks that are connected directly to the bow string would have on it. The holding cord itself is preferably formed of a low-friction flexible woven material such as nylon, and is itself protected from the destructive action of the nib 14 by the cylindrical bushing 22 which would preferably be formed of a tough, low-friction material such as nylon.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A bow string release, comprising:

a. a housing, b. a nib moveably mounted in the housing between a first position in which a bow string is held and a second position in which the bow string is released, the nib being biased by the bow string toward the second position when the bow string is released, the nib being mounted on a nib bar and the nib bar being pivotally mounted to the housing, c. a lock mechanism mounted in the housing, the locking mechanism including a sear and an actuator, extremely small movement of the actuator causing extremely small movement of the sear from a lock position in which the nib is held in its first position by the sear to a release position in which the nib is released by the sear, the nib bar carrying the nib at one end, being pivoted at an intermediate portion and carrying an edge at a second end, wherein the sear bar is mounted in the housing for movement away from the nib bar, the sear bar having a sear which overlap the edge of the nib bar from time to time to hold the nib bar from pivoting, the amount of overlap being extremely short and the sear being moveable away from the edge with the sear bar to end the overlap between the sear and the edge, the sear bar having a first end, a second end and an intermediate portion and being pivotally mounted in the housing by its first end, with the sear on its intermediate portion, and wherein the actuator has a first end, an intermediate portion and a second end, and the actuator being pivotally mounted in the housing at its intermediate portion with its first end engaging the second end of the sear bar and its second end extending outwardly of the housing.

2. A release as recited in claim 1, wherein a slot is formed in the housing and the nib crosses the slot in the nib's first position but is outside of the slot in its second position.

3. A release as recited in claim 1, wherein a slot is formed in the housing having a center line passing through the housing and the nib bar has a pivot axis which is to one side of the center line, thereby causing pressure on the nib outwardly along the center line to bias the nib out of the slot.

4. A release as recited in claim 1, including a flexible holding cord having a first end attached to the housing and a second end capable of being held by the nib while in its first position and released from the nib as it leaves its first position, the holding cord being the element which actually engages a bow string.

5. A release as recited in claim 4, wherein the cord is a loop the bight of which is in the second end and through which the nib passes to hold the cord.

6. A release as recited in claim 5, wherein a peripheral bushing surrounds the bight of the loop, the bushing being formed of tough low-friction material and interposing between the cord and the nib when the cord is held by the nib.

* * * * *